US010539385B2

(12) United States Patent
Verney-Carron

(10) Patent No.: US 10,539,385 B2
(45) **Date of Patent: *Jan. 21, 2020**

(54) SEMIAUTOMATIC FIREARM WITH MANUAL RECHAMBERING

(71) Applicant: Verney-Carron S.A., Saint Etienne (FR)

(72) Inventor: Pierre Jean Marie Verney-Carron, Rivas (FR)

(73) Assignee: Verney-Carron S.A., Saint Etienne (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/084,561

(22) PCT Filed: Mar. 7, 2017

(86) PCT No.: PCT/FR2017/050501

§ 371 (c)(1),
(2) Date: Sep. 13, 2018

(87) PCT Pub. No.: WO2017/158256

PCT Pub. Date: Sep. 21, 2017

(65) Prior Publication Data

US 2019/0072349 A1 Mar. 7, 2019

(30) Foreign Application Priority Data

Mar. 14, 2016 (FR) ..... 16 52098

(51) Int. Cl.
*F41A 17/00* (2006.01)
*F41A 17/42* (2006.01)
(Continued)

(52) U.S. Cl.
CPC ..... *F41A 17/42* (2013.01); *F41A 17/74* (2013.01); *F41A 17/76* (2013.01); *F41A 17/78* (2013.01); *F41A 17/80* (2013.01)

(58) Field of Classification Search
CPC ..... F41A 17/80; F41A 17/42; F41A 17/74; F41A 17/52; F41A 15/14; F41A 11/00
(Continued)

(56) References Cited

U.S. PATENT DOCUMENTS 1,930,864 A 10/1933 Schmeisser
2,894,346 A 7/1959 Smith
(Continued)

FOREIGN PATENT DOCUMENTS

FR 3019887 10/2015
WO WO 2017/158256 9/2017

OTHER PUBLICATIONS

Rapport de Recherche Internationale et l'Opinion Ecrite [International Search Report and the Written Opinion] Dated Jun. 27, 2017 From the International Searching Authority Re. Application No. PCT/FR2017/050501. (11 Pages).

*Primary Examiner* — Michael D David

(57) ABSTRACT

The semiautomatic firearm comprises:
a movable assembly (4) adapted to move
against a return spring (10) by recovered energy resulting from pressure exerted when firing an ammunition (7), wherein the firearm comprises a stopper, a latch and a striker cooperating with a hammer (5) controlled by a trigger (6),
at least one of a pivoting fork and a hammer used for locking the movable assembly in a compressed position of the return spring at a rear position of movement of the movable assembly, after each shot,
an unlocking assembly (12) that is manually actionable and able to act on at least one of the pivoting fork and the hammer for releasing the movable assembly (4) and allowing the assisted return of the movable assembly (4) in order for reloading.

8 Claims, 2 Drawing Sheets

(51) Int. Cl.

| | |
|---|---|
| ***F41A 17/78*** | (2006.01) |
| ***F41A 17/80*** | (2006.01) |
| ***F41A 17/74*** | (2006.01) |
| ***F41A 17/76*** | (2006.01) |

(58) Field of Classification Search
USPC ..... 42/70.08, 25, 70.06; 89/148
See application file for complete search history.

(56) References Cited

U.S. PATENT DOCUMENTS

| | | | | | |
|---|---|---|---|---|---|
| 3,577,668 | A * | 5/1971 | Ruger | F41A 17/46 | 42/69.02 |
| 3,584,533 | A * | 6/1971 | Allyn | F41A 3/54 | 42/25 |
| 4,024,664 | A | 5/1977 | Murabito | | |
| 4,833,811 | A * | 5/1989 | Wilkinson | F41A 17/02 | 42/66 |
| 5,608,981 | A * | 3/1997 | Canaday | F41A 15/16 | 42/25 |
| 5,678,340 | A * | 10/1997 | Moon | F41A 15/12 | 42/25 |
| 5,835,978 | A * | 11/1998 | Canaday | F41A 15/12 | 89/138 |
| 6,883,262 | B1 * | 4/2005 | Von Muller | F41A 17/00 | 42/70.01 |
| 8,650,788 | B2 * | 2/2014 | Ostanin | F41A 17/80 | 42/70.08 |
| 9,062,926 | B2 * | 6/2015 | Lee | F41A 15/14 | |
| 9,476,660 | B2 * | 10/2016 | Potter | F41A 17/52 | |
| 10,222,160 | B2 * | 3/2019 | Gillette | F41A 19/10 | |
| 2017/0045318 | A1 * | 2/2017 | Verney-Carron | F41A 3/26 | |
| 2019/0093971 | A1 * | 3/2019 | Verney-Carron | F41A 17/42 | |

* cited by examiner

SEMIAUTOMATIC FIREARM WITH MANUAL RECHAMBERING

RELATED APPLICATIONS

This application is a National Phase of PCT Patent Application No. PCT/FR2017/050501 having International filing date of Mar. 7, 2017, which claims the benefit of priority of French Patent Application No. 1652098 filed on Mar. 14, 2016. The contents of the above applications are all incorporated by reference as if fully set forth herein in their entirety.

FIELD AND BACKGROUND OF THE INVENTION

The invention belongs to the technical field of firearms and more specifically relates to a semiautomatic firearm of any caliber.

As is fully known to the person skilled in the art, this type of firearm comprises a movable assembly mounted in a breech housing. This movable assembly comprises, essentially, a stopper, a latch and a striker, which can be struck by the effect of swinging a hammer controlled by a trigger, against a return spring.

For this type of semiautomatic firearm, arming the striker system is done by moving the movable assembly, which can be done by recovery of energy released by a fired ammunition. This recovery can be done by means of an inertial system, a system taking gas from the barrel, or by recoil of the barrel.

Because of the operating principle of a semiautomatic firearm, the cartridge is immediately re-chambered, which can lead to a risk of accidents.

The goal of the invention is to remedy these disadvantages simply, safely, effectively and rationally.

The problem that the invention proposes to resolve is proposing an additional safety able to create a time delay around chambering. Rechambering becomes a manual and intentional action.

To resolve such a problem, a semiautomatic firearm was designed and developed comprising means capable of recovering energy resulting from pressure exerted when firing an ammunition to move a movable assembly against a return spring and comprising a stopper, a latch and a striker cooperating with a hammer controlled by a trigger.

SUMMARY OF THE INVENTION

According to the invention, in consideration of the problem to be resolved, the semiautomatic type of firearm comprises:

- locking means for locking the movable assembly in a compressed position of the return spring at a rear position of movement of the movable assembly, after each shot,
- a manually actuatable unlocking assembly capable of acting on the locking means to release the movable assembly to allow the assisted return of said movable assembly to perform an ammunition reloading.

In a first advantageous embodiment of the invention, the locking means are made up by the hammer, which cooperates with the movable assembly to lock the movable assembly at the rear position of movement.

It follows from these features that the invention acts on a key part, which is the hammer.

In this first embodiment, when the unlocking assembly is manually actuated, it cooperates with two parts, able to neutralize the striker system of the firearm, by making the hammer inoperative, where said two parts are made up of an unlocking finger and an unlocking notch.

The unlocking notch has a beak engaging with a boss on the hammer to make it drop when the unlocking assembly is manually actuated.

The unlocking assembly is securely connected with the unlocking finger, by means of a pivoting pin that said assembly has, where said pivoting pin has a polygonal male step cooperating with a female cavity having a complementary shape, formed in a thickness of the unlocking finger.

In another embodiment, the locking means are made of a pivoting fork connecting with the movable assembly.

In this other embodiment, the unlocking assembly cooperates, when it is manually actuated, with a part able to neutralize the striker system of the firearm by disengaging the trigger, where said unlocking assembly is made up of an articulated lever mounted pivotably relative to an articulation pin and having an operating finger cooperating with an opening in order to be accessible from outside the firearm.

BRIEF DESCRIPTION OF THE SEVERAL VIEWS OF THE DRAWINGS

The invention is disclosed below in detail with the help of the figures from the attached drawings, in which.

DESCRIPTION OF SPECIFIC EMBODIMENTS OF THE INVENTION

Figure 1:
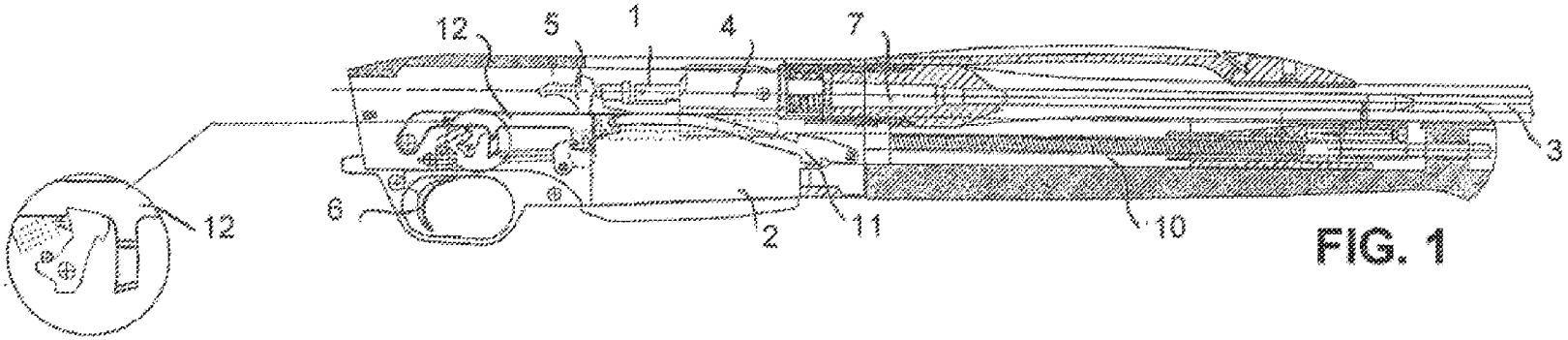
FIG. 1 is a partial longitudinal section view of an example of a firearm according to the features of the invention shown in phase 1 of firing.

As indicated, the invention applies to any semiautomatic type firearm, whatever the caliber.

This type of firearm is fully known to the person skilled in the art and can have several embodiments. For the most part, this firearm type has a stock, not shown, a breech housing (1), a magazine (2) and a barrel (3). The breech housing (1) receives a movable assembly (4) essentially comprising a stopper, a latch and a striker, which is struck by the effect of swinging a hammer (5) controlled by a trigger (6).

Arming of the movable assembly (4) is done by means capable of recovering energy resulting from pressure exerted when firing an ammunition (7). This energy can be recovered either by inertia, by a gas operated system, or even by recoil of the barrel, as is currently used in semiautomatic type firearms. This energy recovery therefore allows the movement of the movable assembly (4) against a return spring (10). Finally, the firearm comprises locking means for locking the movable assembly (4) in a compressed position of the return spring (10) at a rear position of movement of the movable assembly, after each shot.

The firearm has an unlocking assembly (12) that is manually actionable and able to act on the hammer (5), for releasing the movable assembly (4) and allowing the assisted return of said assembly, in order for reloading. The unlocking assembly is made up of an operating lever (12), accessible from outside the firearm.

More specifically, the unlocking lever (12) is secured to the hammer (5), which consequently constitutes the locking means by cooperating with two parts (15) and (15*a*), able to neutralize the striker system of the firearm, consequently making said hammer (5) inoperable.

Figure 7:
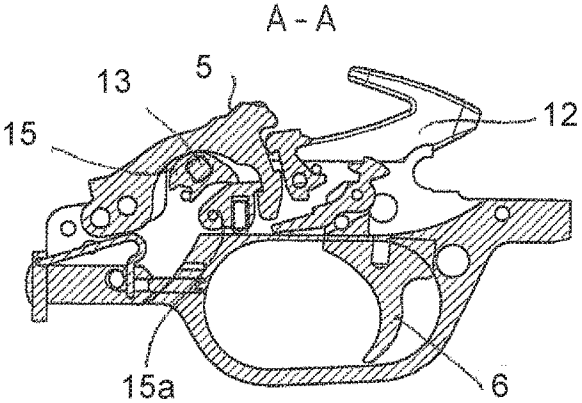
FIG. 7 is a longitudinal section view, taken along line A-A from FIG. 5.
Figure 3:
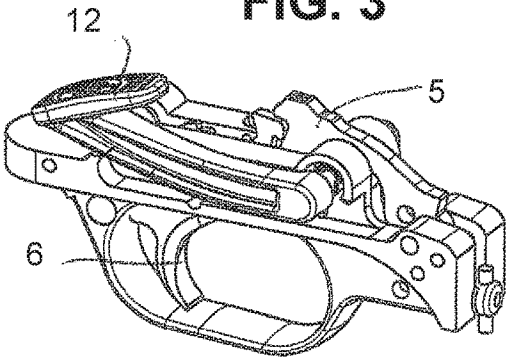
FIG. 3 is a perspective view of the lower receiver, showing in particular the hammer controlled by the unlocking assembly, corresponding to the advantageous embodiment, according to the invention.

As FIG. 7 shows more specifically, these two parts are made up by an unlocking finger (15) and an unlocking notch (15*a*).

Figure 8:
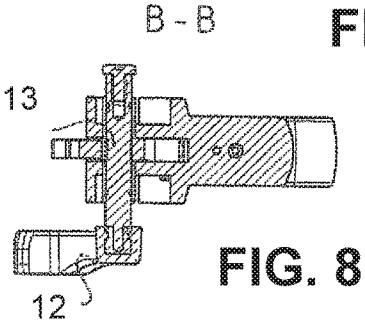
FIG. 8 is a section view, taken along the line B-B from FIG. 6.

The unlocking lever (12) is securely connected with the unlocking finger (15) by means of a pivoting pin (13), which said lever (12) has; said pin is inserted transversely, FIG. 8.

More specifically, this pin (13) has a polygonal male step, for example square-shaped, cooperating with a female cavity having a complementary shape, formed in a thickness of the unlocking finger (15).

Thus, when one acts on the unlocking lever (12), the unlocking finger (15), which cooperates by supporting with the unlocking notch (15*a*), acts on said notch, which has a beak cooperating with a boss on the hammer, to make it go down.

The result of these features is that the locking back of the movable assembly is done directly by the hammer, which constitutes a key part of the firearm.

Figure 2:
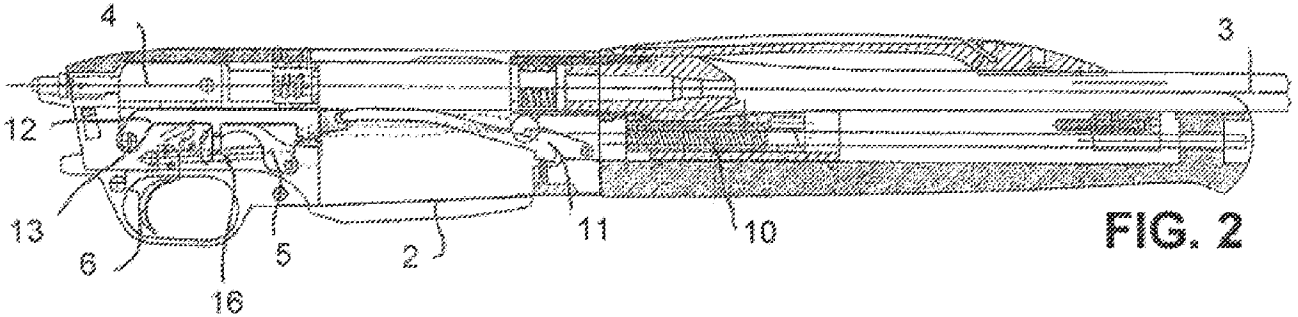
FIG. 2 is a view corresponding to FIG. 1 shown in phase 2 of locking the movable assembly at a rear position of the movement.
Figure 4:
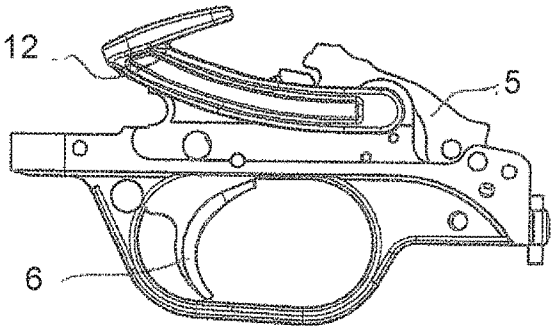
FIG. 4 is a front view corresponding to FIG. 3.
Figure 6:
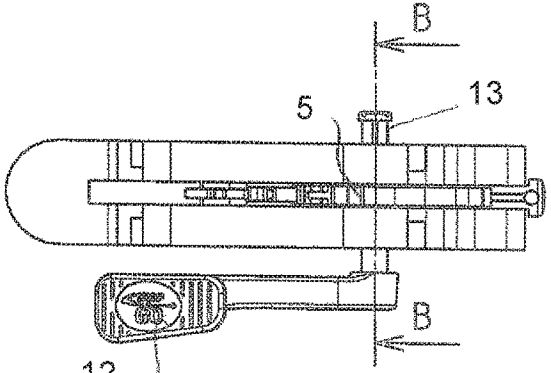
FIG. 6 is a top view from FIG. 3.
Figure 5:
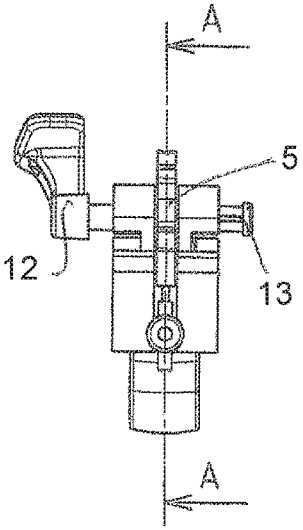
FIG. 5 is a side view from FIG. 4.

In another embodiment, these locking means are made of a pivoting fork (11) connecting with the movable assembly (FIGS. 1 and 2).

In this embodiment, the unlocking assembly is made up of an articulated lever (12) mounted pivotably relative to an articulation pin (13) and having an operating finger cooperating with an opening in order to be accessible from outside the firearm.

As with the previous embodiment, to avoid a shunting of the locking at a rear position of the movement of the movable assembly (4) by exerting, for example, a continuous pressure on this lever (12), this lever cooperates, when it is actuated manually, with a part (15) able to neutralize the striker system of the firearm by disengaging the trigger.

The following is the operation of the firearm:

After firing the firearm, the firearm is closed, the hammer (5) strikes the movable assembly (strikes the striker) (4) for the discharge of the ammunition (7).

Under the effect of the pressure exerted by the discharge of the ammunition, the energy is recovered for the movement of the movable assembly (4).

Under the effect of recovery of the energy, there is an assisted ejection of the ammunition (7). The hammer (5) is rearmed under the effect of the recoil of the movable assembly (4); the hammer spring (16) is compressed. In this position, there is therefore an assisted ejection of the ammunition (7), assisted loading of the hammer (5) spring (16) and assisted loading of the return spring (10).

After unlocking, the movable assembly (4) is unlocked following pressing on the lever, secured to the hammer (5) or to the fork (11). The result of this is the disengagement of the trigger (6), which consequently blocks the striker system.

It follows from these features that, in the case of a semiautomatic rifle, the movable assembly is locked by the hammer (5) or the fork (11), which increases the safety by placing a stop at a rear position of the movement of the movable assembly, such that the cartridge is not immediately rechambered. A time delay is obtained before chambering. Rechambering becomes a manual and intentional action.

What is claimed is:

1. A semiautomatic firearm comprising means capable of recovering energy resulting from pressure exerted when firing an ammunition to move a movable assembly against a return spring, wherein the firearm comprises a stopper, a latch and a striker mounted to be struck by a hammer controlled by a trigger, wherein the hammer is able to lock the movable assembly in a compressed position of the return spring at a rear position of movement of the movable assembly, after each shot, and wherein the firearm comprises a manually actuatable unlocking assembly capable of acting on the hammer to release the movable assembly to allow the assisted return of the movable assembly to perform an ammunition reloading.

2. The semiautomatic firearm according to claim 1, wherein the unlocking assembly, when manually actuated, cooperates with a first part and a second part, the first part and the second part are able to neutralize the striker of the firearm, by making the hammer inoperative.

3. The semiautomatic firearm according to claim 2, wherein the first part is an unlocking finger and the second part is an unlocking notch.

4. The semiautomatic firearm according to claim 3, wherein the unlocking notch has a beak cooperating with a boss on the hammer to make the hammer drop when the unlocking assembly is manually actuated.

5. The semiautomatic firearm according to claim 3, wherein the unlocking assembly is securely connected with the unlocking finger, by means of a pivoting pin that has the unlocking assembly.

6. The semiautomatic firearm according to claim 5, wherein the pivoting ping has a polygonal male step cooperating with a female cavity having a complementary shape, formed in a thickness of the unlocking finger.

7. The semiautomatic firearm according to claim 1, wherein the unlocking assembly, when manually actuated, cooperates with a first part (15) able to neutralize the striker of the firearm by disengaging the trigger.

8. The semiautomatic firearm according to claim 7, wherein the unlocking assembly is made up of an articulated lever mounted pivotably relative to an articulation pin and having an operating finger cooperating with an opening in order to be accessible from outside the firearm.

* * * * *